United States Patent [19]

Hochstrasser et al.

[11] Patent Number: 4,809,450

[45] Date of Patent: Mar. 7, 1989

[54] IRONING PRESS WITH INCORPORATED SLEEVE-BOARD

[75] Inventors: Walter P. Hochstrasser, Bernex; Gertrud B. Roch, Vessy, both of Switzerland; Yves Venturini, Ville-La-Grand, France; Olindo Baruffa, Thonex, Switzerland

[73] Assignee: Mefina S.A., Fribourg, Switzerland

[21] Appl. No.: 131,136

[22] PCT Filed: May 25, 1987

[86] PCT No.: PCT/CH87/00059

§ 371 Date: Nov. 9, 1987

§ 102(e) Date: Nov. 9, 1987

[87] PCT Pub. No.: WO87/07661

PCT Pub. Date: Dec. 17, 1987

[30] Foreign Application Priority Data

Jun. 5, 1986 [CH] Switzerland ..... 2279/86
Mar. 13, 1987 [CH] Switzerland ..... 949/87

[51] Int. Cl.[4] ..... D06F 71/36

[52] U.S. Cl. ..... 38/36; 38/135; 223/72; 108/65

[58] Field of Search ..... 38/135, 36, 27–35, 38/37–41, 21–25; 223/72; 108/13, 65, 64, 69; D32/9

[56] References Cited

U.S. PATENT DOCUMENTS

| | | | |
|---|---|---|---|
| 2,888,759 | 6/1959 | Nennen | 38/135 |
| 3,325,928 | 6/1967 | Mazzolla | 38/36 |
| 4,689,905 | 9/1987 | Vartan | 38/28 |

FOREIGN PATENT DOCUMENTS

| | | |
|---|---|---|
| 370450 | 3/1923 | Fed. Rep. of Germany . |
| 479920 | 5/1916 | France . |
| 1143385 | 9/1957 | France . |
| 1389563 | of 1965 | France . |
| 2038767 | 1/1971 | France . |
| 2172963 | 10/1973 | France . |
| 1249825 | 10/1971 | United Kingdom . |

*Primary Examiner*—Andrew M. Falik
*Attorney, Agent, or Firm*—Young & Thompson

[57] ABSTRACT

An ironing press comprises a heated plate (6) and an arm (5) that can be applied against an ironing board (22). The latter is mounted on a support (28) which can be moved along ramps (30) to reach a lowered position, thus making it possible to lift a sleeve-board (37) which is mounted on arms (38 and 39) in order to bring this sleeve-board substantially to the same level as the level at which the board (22) was previously located. An operating knob (41) allows the sleeve-board (37) or the board (22), as desired, to be locked in the working position or to be both released to allow their positions to be interchanged.

16 Claims, 4 Drawing Sheets

IRONING PRESS WITH INCORPORATED SLEEVE-BOARD

BACKGROUND OF THE INVENTION

Ironing presses are already known which comprise a base having a board for supporting the articles to be ironed, and an arm that is articulated on the base and has a heated plate which is to be pressed against the board after the article to be ironed has been placed thereon.

These presses are very suitable for ironing relatively large pieces of material, but they are relatively difficult to handle for the careful ironing of small sections of clothing, especially shirt sleeves. In order to solve this problem, it has already been proposed, for example in French Pat. No. 2 038 767, to provide an accessory forming a sleeveboard, which can be used with an ironing press. This sleeve-board is placed above the ironing board and is located in an oblique plane in order to allow its entire surface to come into contact with the heated plate, the latter cooperating with the sleeve-board well before its normal ironing position on the board. As a result, ironing must be carried out on an inclined sleeve-board surface with a heated plate that is also inclined, which is not very practical for the user.

OBJECT AND SUMMARY OF THE PRESENT INVENTION

The object of the invention is to permit ironing, with a press, on a sleeve-board the plane of which corresponds to that of the ironing board.

To that end, the ironing press forming the subject of the invention is characterised in that it comprises a built-in sleeve-board and means that allow the press to be used with the ironing board or the sleeve-board, as desired, the working level being substantially the same for the sleeve-board and for the ironing board.

BRIEF DESCRIPTION OF THE DRAWINGS

The attached drawings show diagrammatically and by way of example two embodiments and variants of the ironing press forming and subject of the invention.

DETAILED DESCRIPTION OF THE INVENTION

Figure 1:
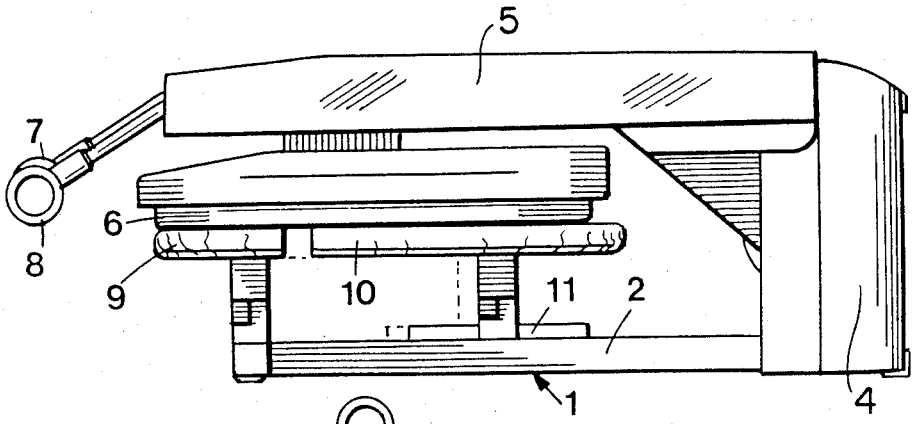
FIG. 1 is a side view of one embodiment, the press being in the ironing position.
Figure 2:
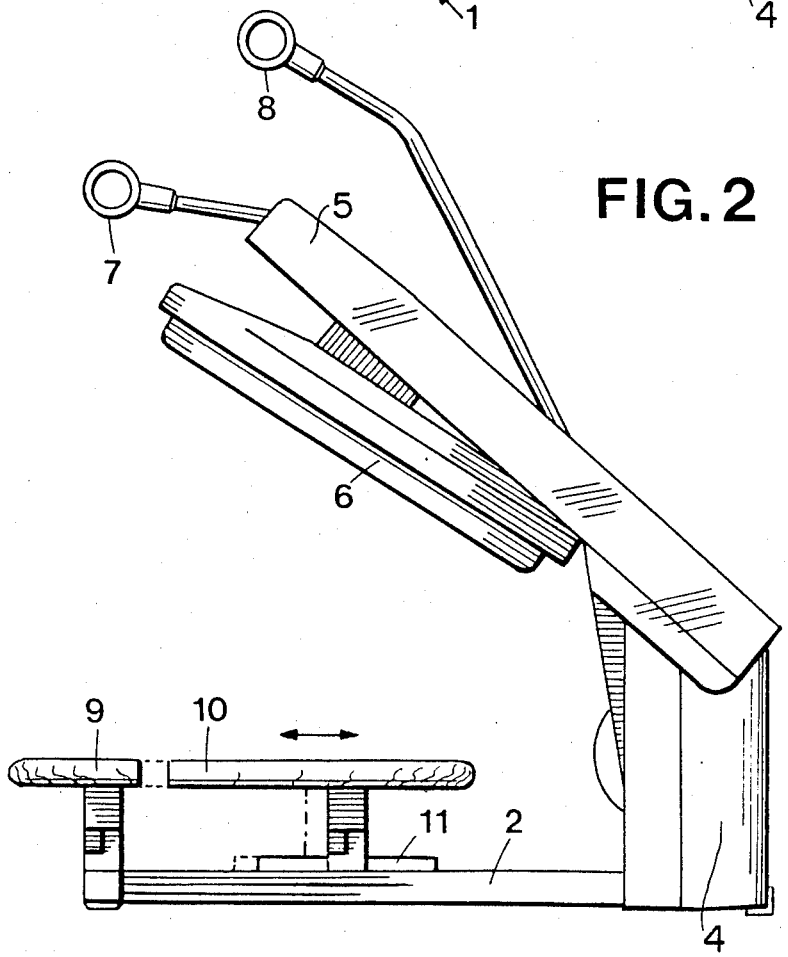
FIG. 2 shows the same press, but in the open position.
Figure 3:
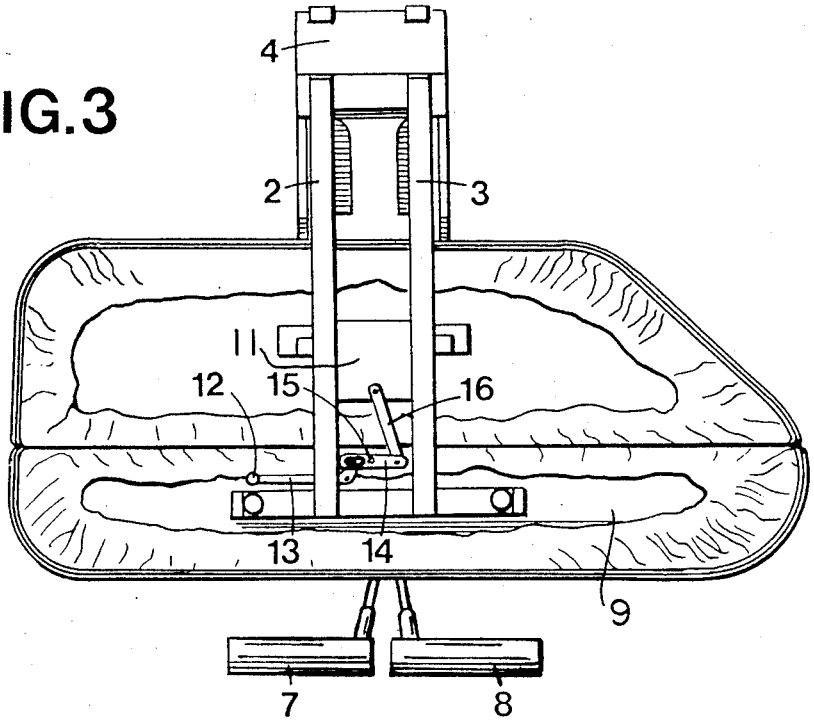
FIG. 3 is a bottom view of the press according to FIG. 1.

The ironing press shown in FIGS. 1 to 3 comprises a base 1 formed by two parallel tubes 2 and 3 of square cross-section, these tubes being joined to a pillar 4 on which there is articulated an arm 5 having a heated plate 6. In known manner, the arm 5 is operated by means of two handles 7 and 8, the latter locking the arm 5 in the ironing position. In that position, the heated plate 6 is applied with a certain pressure against a board, on which articles to be ironed have been placed.

The ironing board is in two parts 9 and 10, both of which are supported by the base 1. The part 10 is mounted on a sliding carriage 11 which is guided between the tubes 2 and 3, and a mechaism makes it possible to slide the part 10 in order to move it, in horizontal translation, away from the part 9, which is rigidly joined to the tubes 2 and 3. The two parts 9 and 10 are shown separated from one another in FIGS. 1 and 2, while they are shown in their closed-up position in FIG. 3. In this closed-up position, these two parts together form the ironing board, while in their separated position it is possible to use the part 9 alone as a sleeve-board. Of course, each part is provided with a cover on resilient padding, such as a synthetic material made of heat-resistant foam.

As can be seen in FIG. 3, the mechanism for moving the rear part 10 of the ironing board comprises an operating handle 12 formed by the end of one arm of a bent lever 13, the other arm of which has a stud which is engaged in a slot in a lever 14 that pivots about an axis 15. This lever 14 is connected to the sliding carriage 11 by way of a connecting rod 16.

When the handle 12 is pushed towards the pillar 4, the lever 13 causes the lever 14 to pivot in an anticlockwise direction and pushes the part 10 of the board towards the pillar 4 in order to allow the part 9 to be used as a sleeve-board. The levers 13 and 14 are so arranged that, when the parts 9 and 10 are in the closed-up position, the mechanism is in a locking position, so that no direct action on the part 10 can move it since it is irreversibly connected to the handle 12.

Figure 4:
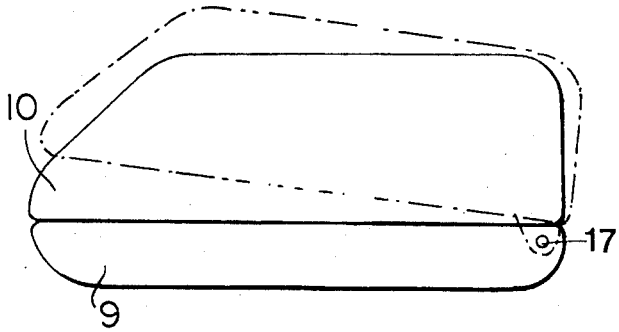
FIGS. 4 and 5 relate to two variants.

FIG. 4 shows a variant of the board, the part 10 of which may be moved away from the part 9 by a pivoting movement about an axis 17, this axis being oriented perpendicularly to the ironing board.

Figure 5:
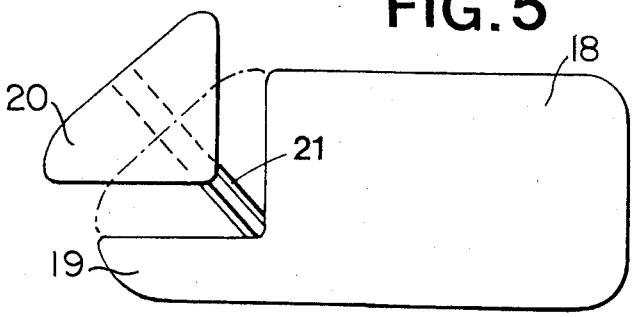

In the case of FIG. 5, the ironing board comprises a main part 18 that is fixedly joined to the base, this part 18 having a nose 19 which can be used as a sleeve-board. A second, moving part 20 that is slidably mounted on a guide 21 can be moved away from the part 18 in order to free the nose 19 when it is desired to use the sleeve-board.

The board could also be in more than two parts. According to an advantageous solution, the part 10 in FIG. 3 could be divided into two portions joined together along a line parallel to those edges of the parts 9 and 10 that are in contact. The rear portion of the part 10 could be fixed, while the front portion of the part 10 would be articulated with the rear portion by way of a hinge extending along the edges of these portions that are in contact. Thus, the front portion would occupy a longitudinal central strip of the board and could be folded downwards in order to allow the part 9 to be used as a sleeve-board.

According to another variant, a middle strip of the board could be used as a sleeve-board, it being possible to move the front and rear strips in order to free this middle strip.

Figure 6:
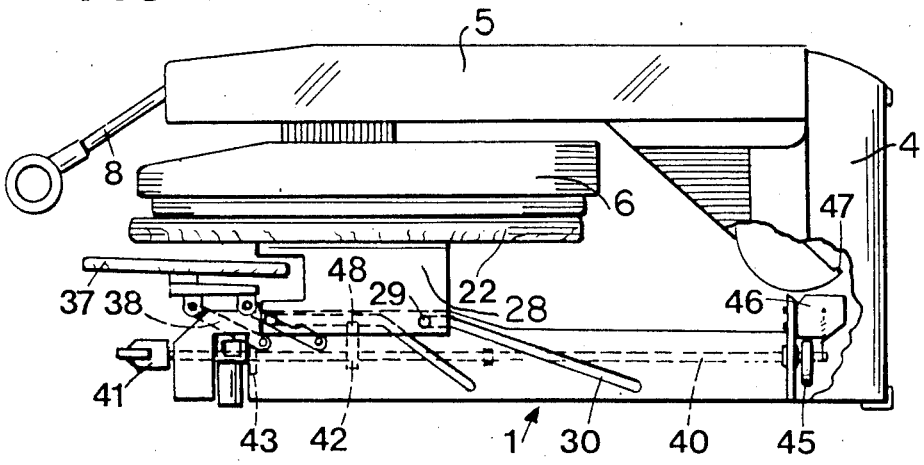
FIG. 6 is a side view of the second embodiment, the press being closed in the position for ironing by means of the main board.

In the second embodiment, the press shown in FIG. 6 comprises a base 1 that is fixedly joined to an upright 4 on which there is articulated an arm 5 having a heated plate 6. The arm 5 is provided with a handle 7 which serves to close the press, and with a locking arm 8 which applies a resilient force from the heated plate 6 onto an ironing board 22. This technique is well known and will therefore not be described in detail.

The ironing board 22 is mounted on a support 28 having runners 29 which are engaged in ramps 30 provided in the member forming the base 1. These ramps are inclined relative to the support plane of the base 1 and allow the board 22 to be guided from the working position shown in FIG. 6 to a retracted position, which can be seen in FIG. 7.

Figure 10:
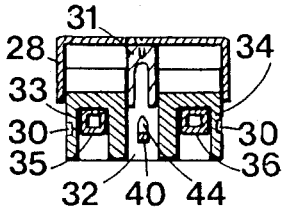
FIG. 10 is a partial section along the line V—V in FIG. 8.

The means for guiding the support 28 and thus the board 22 are shown in greater detail in FIG. 10. It will be seen that the U-shaped support 28 has a member 31 that is also U-shaped, the latter being engaged in a slot 32 serving as a slide rail for lateral guiding. This slot is located between two portions 33 and 34 of a member that forms part of the base 1 in combination with tubes of rectangular cross-section 35 and 36 forming the framework of the press. Grooves forming the ramps 30 are provided in the outer lateral faces of the portions 33 and 34.

Figure 7:
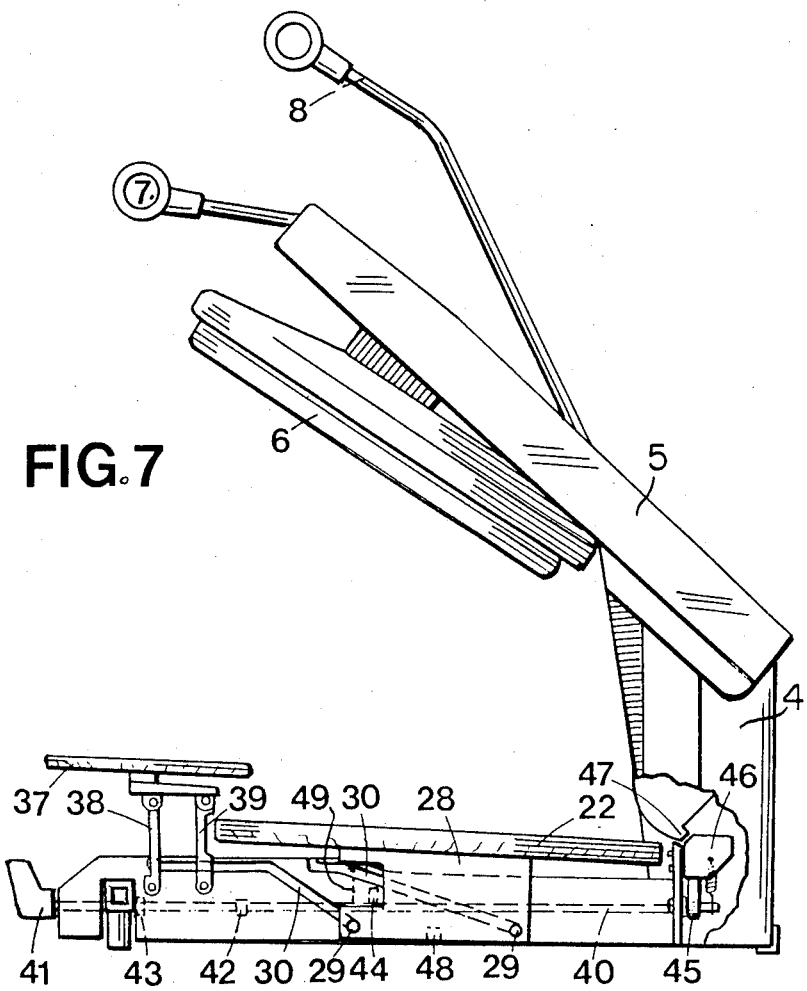
FIG. 7 shows the press of FIG. 6 in the position in which it is open and arranged for use of the sleeve-board.
Figure 8:
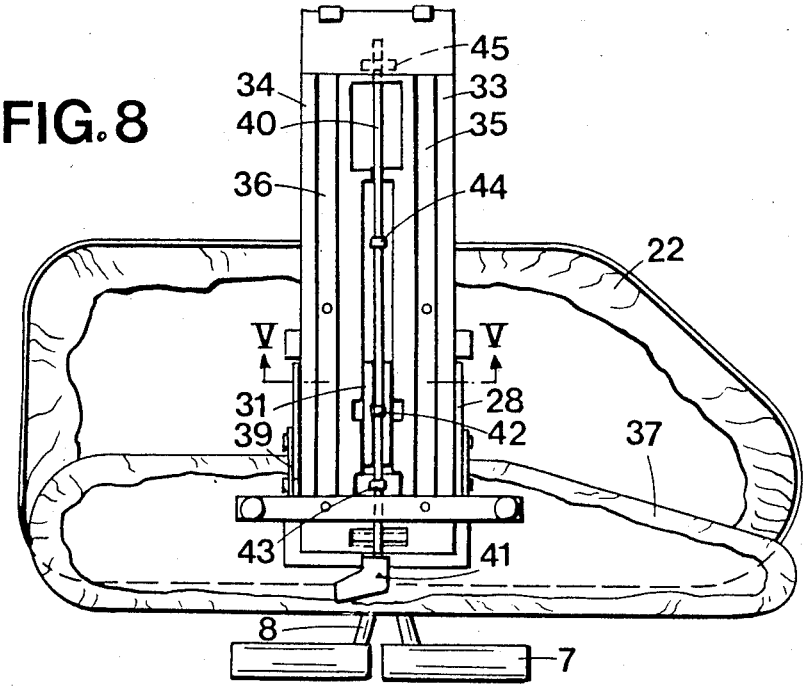
FIG. 8 is a view of the underside of the press of FIG. 6.
Figure 9:
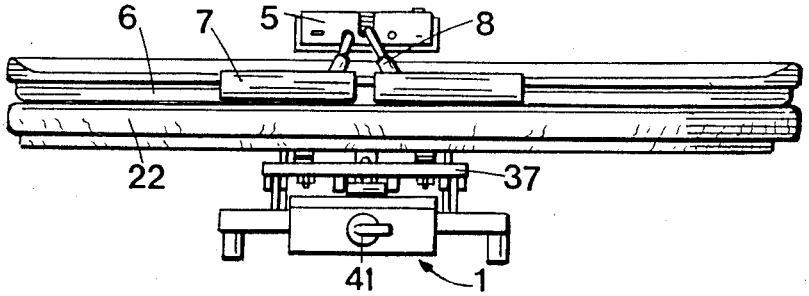
FIG. 9 is a front view of that press of FIG. 6.

The press also has a sleeve-board 37 which can be moved from a position in which it is not in use, which is shown in FIG. 6, to a working position, as shown in FIG. 7. This sleeve-board is supported by an assembly of arms 38, 39 forming a deformable parallelogram and can be moved manually from its retracted position, according to FIG. 6, to its working position, which is shown in FIG. 7. It goes without saying that, when the sleeve-board 37 is in the working position, the ironing board 22 must be in the retracted position, and that, conversely, when the board 22 is being used, the sleeve-board 37 must be in the lowered position. Moreover, this feature allows the sleeve-board 37 to be substantially equal in length to the board 22.

It should be noted that the sleeve-board and the board 22 are virtually at the same level when they are in the working position, so that, during ironing, the arm 5 and the heated plate 6 are substantially in the same position for cooperating both with the sleeveboard and with the ironing board 22.

In order to ensure that the sleeve-board 37 and the board 22 are stable in their working positions, the press is provided with means for locking these two parts in their use positions. To that end, the press has a rod 40 which extends in the slot 32 located between the portions 33 and 34. At the end of this rod 40, at the front face of the press, there is a manualoperation knob 41. The rod forms a member for locking the support 28 by means of a radical arm 42 which, in one position of the rod, engages in a recess 48 in the central portion of that support 28. When it is desired to use the sleeve-board 37 in place of the board 22, it is first necessary to turn the knob 41 in order to release the arm 42 from the support 28 and unlock the latter, the press already being open.

It is then possible to move the board 22 manually along the ramps 30 in order to cause it to pass from the position shown in FIG. 6 to that of FIG. 7. The sleeve-board 37 can then be brought manually into the position shown in FIG. 7. The knob 41 is then turned again in order to bring a locking arm 43 into a position facing the articulation arm 38, which prevents the sleeve-board 37 from returing to its retracted position.

The rod 40 also has an arm 44 which engages in the slot in the central member 31 during the lowering movement of the board 22, and which is released from that slot when the board 22 reaches its lowered end position, as shown in FIG. 7. As a result of this arrangement, the rod 40 is locked in position as long as the board 22 is in an intermediate position between its working position and its retracted position.

In order to avoid inadvertent operation, the rear end of the rod 40 has a cam 45 which cooperates with a member 46 that slides vertically when the rod 40 is between the two positions in which it locks the board 22 and the sleeve-board 37, respectively. When the press is open, as shown in FIG. 7, and the rod 40 is in its middle position, the member 46 is located behind a nose 47 fixedly joined to the arm 5 and prevents the press from being closed again as long as the knob 41 has not been turned in order to place it in one of its locking positions for the board 22 or the sleeve-board 37.

This device comprising the cam 45, the member 46 and the nose 47 plays a second very important role: that of locking the rod 40 angularly when it is itself in the locking position for the sleeve-board or the board 22, and the arm 5 having the heated plate 6 is lowered. In fact, in these locking positions, if it was desired to turn the rod 40 by operating the knob 41, the cam 45 would abut laterally against one side of the member 46, thus preventing the rod 40 from rotating and allowing the sleeve-board 37 or the board 22 to be unlocked.

Furthermore, it must be noted that it is not possible to operate the rod 40 when neither the sleeve-board 37 nor the board 22 is in the working position, the knob 41 being in the position shown in FIG. 7, which allows the sleeve-board 37 and the board 22 to be moved manually while the heated plate 6 is raised. In fact, if the sleeve-board 37 is in the lowered position, as shown in FIG. 6, the locking arm 43 abuts laterally against the articulation arm 38, which prevents the rod 40 from being turned in the direction in which the sleeve-board 37 is locked in the working position.

Moreover, when the board 22 is in the lowered position, the arm 44 abuts against an extension 49 of one of the lateral walls of the member 31, which prevents the rod 40 from being rotated in the direction that causes the board 22 to be locked in the high position. Opposite this extension 49, the lateral wall of the member 31 is interrupted, which allows the finger 44 to pass through and thus permits the rod 40 to be rotated in the direction that allows the sleeve-board 37 to be locked.

It will thus be seen that, when the rod 40 is in its middle angular position, which is shown in FIG. 7, it is imperative that either the sleeve-board 37 or the board 22 be in the working position if the operating knob 41 is to be rotated and the sleeve-board or the board selected by the user is to be locked in the working position. Only when the operating knob 41 has been rotated, which produces locking, does the cam 45 release the sliding member 46 and thus allow the arm 5 to be lowered.

We claim:

1. An ironing press comprising a base having an ironing board for supporting an article to be ironed upon an ironing surface and a sleeveboard distinct and separable from said ironing board also having an ironing surface, each said ironing board and sleeve-board being separately supported in a working position during ironing of said article on either respective ironing surface, an arm articulated on said base having a heated plate adapted to be pressed against each said ironing surface of said ironing board and said sleeve-board when said ironing board and said sleeve-board are positioned in said working position, means to permit said heated plate to be pressed against either of said ironing board or said sleeveboard when either of said boards is positioned in said working position, and the ironing surface of each said ironing board and said sleeve-board being substantially in the same plane when said respective boards are placed in said working positions.

2. Press according to claim 1, wherein said ironing board and said sleeve-board are juxtaposed when each ironing surface of said respective boards are in a working position, with adjacent edge portions of said respective boards having complementary configurations.

3. Press according to claim 2, wherein at least one of said ironing board and said sleeve-board is movable relative to the other by substantially horizontal translation.

4. Press according to claim 2, wherein at least one of said ironing board and said sleeve-board is pivotably mounted on said base.

5. Press according to claim 2, wherein at least one of said ironing board and said sleeve-board is movable in a direction that is substantially perpendicular to the plane of the ironing surface of said board.

6. Press according to claim 1, further comprising means for controlling the movements of said ironing board relative to the sleeveboard.

7. Press according to claim 1, wherein said ironing board has an ironing surface of a shape that corresponds substantially to that of the heated plate, said ironing board being movable from a working position in which it cooperates with the heated plate to a non-working retracted position, and the sleeve-board being movable from a non-working retracted position to a working position in which it cooperates with the heated plate.

8. Press according to claim 7, further including means for guiding said ironing board as it passes from one of its positions to the other, said means being arranged to maintain the ironing surface of said board substantially level as it moves from one position to the other, the retracted position being lower than the working position.

9. Press according to claim 7, characterised in that the length of the sleeveboard is substantially equal to that of the board ironing.

10. Press according to claim 8, further including means for guiding said sleeveboard as it passes from one of its positions to the other, said means being arranged to maintain the ironing surface of said sleeve-board level as it moves from one position to the other, its retracted position being located below the ironing board in the working position.

11. Press according to claim 8, further comprising means for locking the sleeve-board and the ironing board in their respective working positions.

12. Press according to claim 11, characterised by a manually operated locking member having at least one locking position and one unlocking position for the sleeve-board and the ironing board, this member cooperating with a locking device which locks the heated plate in the raised position when the said member is in the unlocking position.

13. Press according to claim 12, characterised in that the locking member is provided with locking means that prevents it from being actuated when it is in the locking position for the sleeve-board and/or the ironing board and the arm having the heated plate is lowered.

14. Press according to claim 11, characterised in that the ironing board is carried by a support having runners which rest on inclined ramps that are fixedly joined to the base.

15. Press according to claim 14, characterised in that the support has a projecting lower portion which is engaged in a slot in the base which acts as a slide rail for lateral guiding.

16. Press according to claim 11, characterised in that the sleeve-board is supported by an assembly of arms forming a deformable parallelogram, the means for locking the sleeve-board acting on one of these levers.

* * * * *